US011969069B2

(12) United States Patent
Hwang et al.

(10) Patent No.: US 11,969,069 B2
(45) **Date of Patent: *Apr. 30, 2024**

(54) SHOCK ABSORBING COSMETIC COMPACT

(71) Applicant: CRYSTAL INTERNATIONAL (GROUP), INC., Scarborough (CA)

(72) Inventors: Roger Hwang, Maple (CA); Stephen M. Fisher, II, Sherman, CT (US); William Lloyd Alusitz, Yorktown Heights, NY (US)

(73) Assignee: CRYSTAL INTERNATIONAL (GROUP), Scarborough (CA)

( * ) Notice: Subject to any disclaimer, the term of this patent is extended or adjusted under 35 U.S.C. 154(b) by 0 days.

This patent is subject to a terminal disclaimer.

(21) Appl. No.: 17/986,658

(22) Filed: Nov. 14, 2022

(65) Prior Publication Data

US 2023/0073374 A1 Mar. 9, 2023

Related U.S. Application Data

(63) Continuation of application No. 16/825,424, filed on Mar. 20, 2020, now Pat. No. 11,503,893.

(51) Int. Cl.
*A45D 33/00* (2006.01)

(52) U.S. Cl.
CPC ..... *A45D 33/003* (2013.01); *A45D 2200/05* (2013.01)

(58) Field of Classification Search
CPC . A45D 33/003; A45D 33/008; A45D 2200/05
See application file for complete search history.

(56) References Cited

U.S. PATENT DOCUMENTS

| | | | | |
|---|---|---|---|---|
| 5,135,012 | A | 8/1992 | Kamen et al. | |
| 5,603,340 | A * | 2/1997 | Gueret | A45D 33/00 132/307 |
| 5,682,910 | A | 11/1997 | Kizawa et al. | |
| 6,055,992 | A | 5/2000 | Skarne | |
| 11,503,893 | B2 * | 11/2022 | Hwang | A45D 33/008 |
| 2018/0220769 | A1 * | 8/2018 | Greenfield | A45D 40/22 |

FOREIGN PATENT DOCUMENTS

| | | | | |
|---|---|---|---|---|
| WO | WO2020110467 | * | 6/2020 | A45D 33/00 |

* cited by examiner

*Primary Examiner* — J C Jacyna
(74) *Attorney, Agent, or Firm* — Patterson + Sheridan, LLP

(57) ABSTRACT

A cosmetic compact for solid or semi solid cosmetic product. The cosmetic compact comprising a lid and a base assembly, wherein the base assembly comprising a base, a frame, a shock absorbing member, and at least one cosmetic pan. The shock absorbing member is disposed in a cavity of the base. The shock absorbing member is coupled to the base and is coupled to the at least one cosmetic pan such that a shock imparted on the cosmetic compact is isolated from the at least one cosmetic pan. The shock absorbing member is deformable and comprises a hollow tubular body defining a central bore extending between an upper-flange and a lower-flange of the shock absorbing member.

20 Claims, 4 Drawing Sheets

SHOCK ABSORBING COSMETIC COMPACT

CROSS-REFERENCE TO RELATED APPLICATIONS

This Application is a continuation of U.S. Non-Provisional application Ser. No. 16/825,424, filed on Mar. 20, 2020 of which is incorporated herein by reference in its entirety.

BACKGROUND

Field of the Invention

The present disclosure relates to a cosmetic compact comprising a shock absorbing member to protect against damage from shocks.

Description of the Related Art

Hinged cosmetic containers such as cosmetic compacts are commonly used to hold various cosmetics or make-up including face powder, blush, eye shadow, lip color, and the like. Indeed, virtually every type of make-up can be provided in a form suitable for being contained in a cosmetic compact. Cosmetic compacts allow one or more cosmetics in quantities sufficient for multiple applications to be conveniently stored and/or transported, particularly in receptacles such as cosmetic carriers, handbags or purses, for access and use on demand. Accordingly, cosmetic compacts are very prevalent and highly popular.

Conventional cosmetic compacts typically include a housing a lid pivotally mounted to a base for movement between closed and open positions, and one or more cosmetics contained in the interior of the base. The housings of conventional cosmetic compacts are ordinarily made of substantially rigid or brittle materials, such as plastics and/or metals. Since it is not unusual for cosmetic compacts to be subjected to shocks, such as impacts, vibrations or jarring forces, during use, storage and/or transport, the contents thereof often sustain irreparable damage. The cosmetics within the housings may crack, fracture, chip or crumble. Cosmetics may leak out of damaged housings, and damaged cosmetics may leak out of even intact housings. Damaged cosmetic compacts, therefore, are usually disposed of by their users prematurely, thus resulting in economic loss.

A cosmetic compact having a flexible housing made of a plastic or rubber elastomeric foam to protect against damage from shocks has been proposed in U.S. Pat. No. 6,055,992 to Skarne. A significant drawback to the proposed cosmetic compact is that the flexible housing must rely for dimensional stability upon a dimensionally sturdy mirror and a dimensionally sturdy cosmetic compartment or tray disposed in the lid and base, respectively, of the housing. The dimensional instability of the housing when the mirror and/or the cosmetic compartment are not installed therein renders the compact unsuitable for use when some of the contents are removed.

U.S. Pat. No. 5,135,012 to Kamen et al discloses a cosmetic compact in which the lid and base of the housing are flexible due to being made of a piece of thermoplastic material of nominal thickness. The nominal thickness of the lid and base reduces the structural strength of the housing and provides little protection for the contents against damage from shocks.

U.S. Pat. No. 5,682,910 to Kizawa et al discloses a compact having a soft area along a front wall thereof to define a push button for releasing hooks used to maintain the compact in a closed position. The location and design of the soft area make it ineffective for shock absorption.

From the foregoing, it can be seen that a need exists for cosmetic compacts which are better protected to absorb shocks.

SUMMARY

Accordingly, it is a primary object of the present disclosure to provide a cosmetic compact having a shock absorbing member.

Accordingly, the present disclosure is directed to means for dampening shocks, impacts and vibration transmitted from a base of a cosmetic compact to at least one cosmetic pan supported within the cosmetic compact. The at least one cosmetic pan is adapted to contain solid or semi-solid cosmetic, e.g., a pressed powder, which is susceptible to damage in the form of cracking or crumbling, or in the worst case, release from the pan. The shock absorbing means minimizes or eliminates damage to the cosmetic product caused by external shock, impact or vibration.

According to an embodiment of the present disclosure, there is provided a cosmetic compact comprising a lid and a base assembly. The base assembly comprising a base, a frame, a shock absorbing member, and at least one cosmetic pan.

According to an aspect of the present disclosure, the lid can be coupled to the base and configured to operate between a closed position and an open position. The lid covers the base to avoid exposing the cosmetic in the at least one cosmetic pan to accidental contact and preventing use. In the open position, the lid can be configured to expose the at least one cosmetic pan in the base for use.

According to yet another aspect of the present disclosure, the lid overlies the base to define an interior compartment and is pivotally mounted on the base. Together the base and the lid define a compact casing. The lid has opposed lateral side walls and a front wall which extend generally perpendicular from a top wall of the lid. The front wall of the lid has an extended portion which fits in the recessed portion when the lid is pivoted downward towards the base to close the cosmetic compact.

According to another aspect of the present disclosure, the base has opposed lateral side walls, a front wall and a rear wall. The front wall of the base has a recessed portion.

The top wall of the lid has an interior surface which may comprise a mirror (not shown), such as a mirror that is laminated to the interior surface or the interior surface may itself be a mirror.

According to another aspect of the present disclosure, a recess and a tab are provided, respectively, on the extended portion of the base and in the recessed portion of the lid, and cooperate to releasably maintain the cosmetic compact in the closed position when the lid is pivoted to close the cosmetic compact with extended portion engaging recessed portion of the base. Any suitable closure system known in the art, however, may be used.

According to another aspect of the present disclosure, the frame is coupled to the base and is configured to restrain the at least one cosmetic pan. The frame and the at least one cosmetic pan are disposed inside the base. The base includes a groove that couples to a projection of the frame to help stabilize the frame and prevent movement of the frame within the base. In alternate embodiments of the present disclosure, the frame may be coupled to the base by any other coupling means known in the art.

According to another aspect of the present disclosure, the shock absorbing member is disposed within the base. The shock absorbing member is coupled to the base and is coupled to the at least one cosmetic pan such that some mechanical shock imparted on the cosmetic compact is isolated from the at least one cosmetic pan. Hence, the contents of the at least one cosmetic pan, such as, for example, makeup, is isolated from shocks or vibrations acting upon the cosmetic compact. The shock absorbing member prevents transverse or axial movements of the at least one cosmetic pan relative to the frame and the base; and dampens effect of impact on the at least one cosmetic pan during a fall or vibrations.

According to an aspect of the present disclosure, the shock absorbing member has a flexible and deformable structure that comprises a hollow tubular body defining a central bore extending between an upper flange and a lower flange. The upper flange is slanted with respect to a central longitudinal axis of the shock absorbing member and the lower flange is substantially transverse with respect to the central longitudinal axis of the shock absorbing member. In other embodiments, the upper flange may be substantially transverse with respect to the central longitudinal axis of the shock absorbing member. In still other embodiments, the upper flange and the lower flange both may be substantially transverse or slanted with respect to the central longitudinal axis of the shock absorbing member. Further, the upper flange is substantially circular in shape with at least two straight opposite edges in the circumference and the lower flange is substantially rectangular in shape with curved corners. Further, a maximum width of the upper flange is smaller than a maximum width of the lower flange.

Thus, the shock absorbing member has a horizontal annular body which defines an annular U shaped horizontal groove that faces outside and away from the central bore. More particularly, the hollow tubular body comprises an upper curved portion and a lower curved portion. The upper curved portion comprises an inner concave surface and an external convex surface. The lower curved portion comprises an inner convex surface and an external concave surface.

The shock absorbing member extends between the bottom wall of the base and the frame such that the lower-flange abuts an inner surface of the bottom wall of the base and the upper-flange abuts an inner surface of the frame. More particularly, the shock absorbing member extends between the bottom wall of the base and the frame such that the transverse lower-flange abuts an inner surface of the bottom wall of the base and the slanted upper-flange abuts an inner surface of the frame.

According to an aspect of the present disclosure, an upper inner peripheral surface of the hollow tubular body of the shock absorbing member comprises a step onto which an outer flange of the at least one cosmetic pan abut such that the at least one cosmetic pan is accommodated inside the central bore in a floating state. More particularly, the outer flange of the at least one cosmetic pan abuts a step on an upper inner peripheral surface of the hollow tubular body and the inner concave surface of the upper curved portion of the hollow tubular body of the shock absorbing member such that the at least one cosmetic pan is accommodated inside the central bore in a floating state. In other words, the at least one cosmetic pan is supported by the shock absorbing member only at a peripheral wall of the least one cosmetic pan and a bottom wall of the least one cosmetic pan is neither in contact with the shock absorbing member nor with the bottom wall of the base.

The at least one cosmetic pan may be attached to the shock absorbing member by a glue, a tight fitment or any other attaching means known in the art.

Furthermore, the frame includes an opening that provides access to the contents of the at least one cosmetic pan. The frame locks the at least one cosmetic pan with the shock absorbing member within the base.

According to yet another embodiment, assembling of the base assembly of the cosmetic compact comprises following steps:

1. The shock absorbing member is first securely received in the cavity of the base.

2. Subsequently, the at least one cosmetic pan is secured within the central bore of the shock absorbing member.

3. Thereafter, the frame is mounted over the base to retain the at least one cosmetic pan within the base.

According to an aspect of the present disclosure, the shock absorbing member is made up of a flexible material. The material of the shock absorbing member may be made from any suitable plastic or elastomer material, such as, for example, rubber, styrene, acetal, polyethylene, polypropylene. The member may be made by any suitable method, such as, for example, injection molding, die-cutting, etc.

According to an aspect of the present disclosure, the at least one cosmetic pan may be made from a metal material such as aluminum or plastic or any other material known in art.

According to an aspect of the present disclosure, at least one of said lid and said base is made of a material selected from the group consisting of transparent plastic, opaque plastic, metal, wood, composite, polymer, and ceramic.

According to an aspect of the present disclosure, the lid and/or the base, may take any shape desired, such as, but not limited to, circular, square, rectangular, polygonal, etc. The lid generally has the same or a similar geometric shape as the base. Also, both the interior surface and the exterior surface of the lid may have one or more decorative features attached to the interior surface and/or exterior surface of the lid or decorative features may be a part of the interior surface and/or exterior surface of the lid or printed or painted onto such surfaces. In an embodiment of the disclosure, the lid, particularly the interior surface and/or exterior surface of the lid may be clear or opaque to allow for viewing of the contents of the compact case when the lid is in a closed position.

The above and other objects, features and advantages of the present disclosure will become clear from the following description of the preferred embodiments when the same is read in conjunction with the accompanying drawings.

The above and other objects, features and advantages of the present disclosure will become clear from the following description of the preferred embodiments when the same is read in conjunction with the accompanying drawings.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings.

Figure 1:
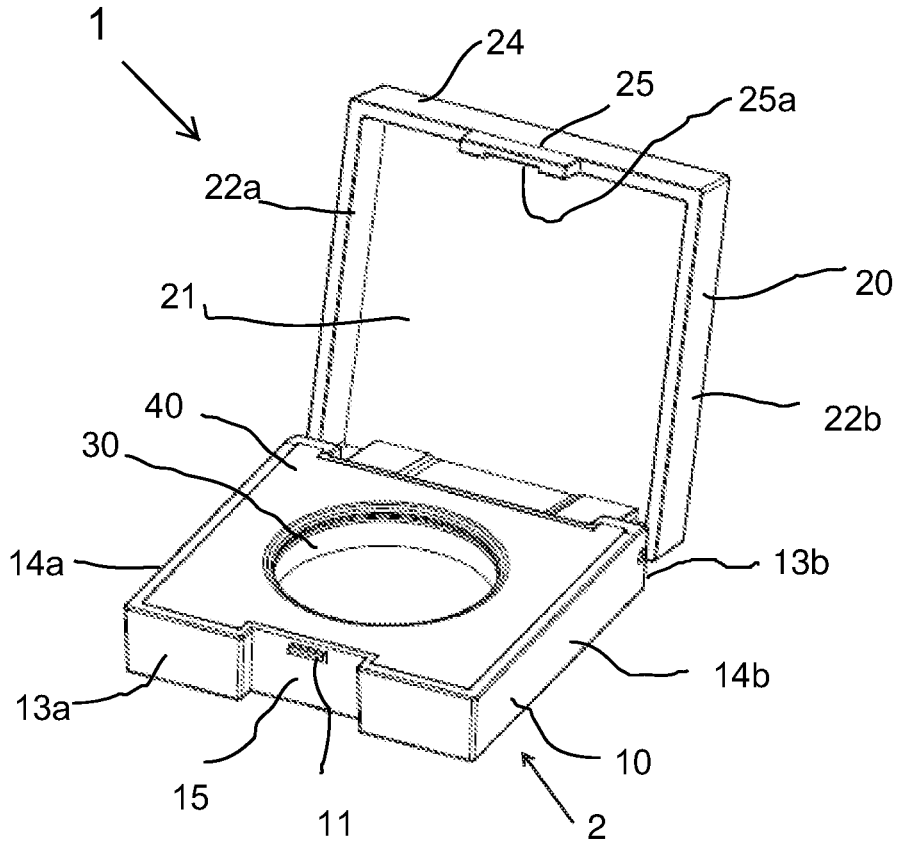
FIG. 1 illustrates a perspective view of a cosmetic compact in an open position according to an embodiment of the present disclosure.

To facilitate understanding, identical reference numerals have been used, where possible, to designate identical elements that are common to the figures. It is to be noted, however, that the appended drawings illustrate only typical embodiments of this disclosure and are therefore not to be considered limiting of its scope, for the disclosure may admit to other equally effective embodiments.

DETAILED DESCRIPTION

Throughout this specification, the terms "comprise," "comprises," "comprising" and the like, shall consistently mean that a collection of objects is not limited to those objects specifically recited.

FIG. 1 illustrates an exemplary embodiment of a cosmetic compact 1 in an open configuration.

Figure 2:
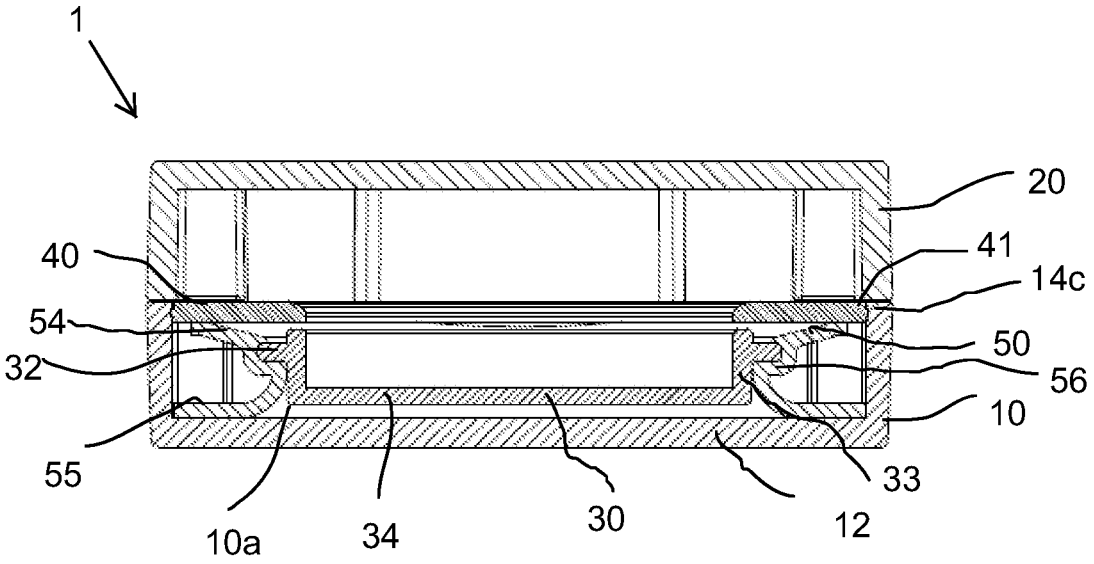
FIG. 2 illustrates a cross sectional view of the cosmetic compact of FIG. 1 in a closed position.

As shown in FIGS. 1 and 2, the cosmetic compact 1 comprising a lid 20 and a base assembly 2. The base assembly comprising a base 10, a frame 40, a shock absorbing member 50, and at least one cosmetic pan 30.

The cosmetic compact 1 has a base 10 having a bottom wall 12 (as shown in FIG. 2). The base 10 can be configured to house at least one cosmetic pan 30. A lid 20 can be coupled to the base 10 and configured to operate between a closed position and an open position. The lid 20 covers the base 10 to avoid exposing the cosmetic in the at least one cosmetic pan 30 to accidental contact and preventing use. In the open position, the lid 20 can be configured to expose the at least one cosmetic pan 30 in the base 10 for use.

As shown in the drawings, particularly FIGS. 1-2, the base 10 has opposed lateral side walls 14*a*, 14*b*, a front wall 13*a* and a rear wall 13*b*. Front wall 13*a* has a recessed portion 15.

More particularly, the lid 20 overlies the base 10 to define an interior compartment and is pivotally mounted on the base 10. Together the base 10 and the lid 20 define a compact casing. The lid 20 has opposed lateral side walls, 22*a*, 22*b*, and a front wall 24, which extend generally perpendicularly from a top wall 21. The front wall 24 of the lid 20 has an extended portion 25 which fits in the recessed portion 15 when the lid 20 is pivoted downwards toward the base 10 to close the cosmetic compact 1.

The top wall 21 of the lid has an interior surface which may comprise a mirror (not shown), such as a mirror that is laminated to the interior surface or the interior surface may itself be a mirror.

A recess 25*a* and a tab 11 are provided, respectively, on the extended portion 25 and in the recessed portion 15, which cooperate to releasably maintain the cosmetic compact 1 in the closed position when the lid 20 is pivoted to close the cosmetic compact 1 with the extended portion 25 engaging the recessed portion 15. Any suitable closure system known in the art, however, may be used.

The lid 20 generally has the same or a similar geometric shape as the base 10. Also, both the interior surface and the exterior surface of the lid may have one or more decorative features attached to the interior surface and/or exterior surface of the lid or decorative features may be a part of the interior surface and/or cover exterior surface of the lid or printed or painted onto such surfaces. In an embodiment of the disclosure, the lid, particularly the interior surface and/or exterior surface of the lid may be clear or opaque to allow for viewing of the contents of the compact case when the lid is in a closed position.

FIG. 1 illustrates a perspective view of an example embodiment of a cosmetic compact 1 in an open configuration. The cosmetic compact 1 also includes a frame 40 coupled to the base 10 and configured to restrain the at least one cosmetic pan 30.

As shown in FIG. 2, the frame 40 and the at least one cosmetic pan 30 are disposed inside the base 10. The base 10 includes a groove 14*c* that couples to a projection 41 of the frame 40 to help stabilize the frame 40 and prevent movement of the frame 40 within the base 10.

The cosmetic compact 1 includes a shock absorbing member 50 disposed in a cavity 10*a* of the base 10 between the bottom wall 12 of the base and the frame 40. The shock absorbing member 50 is coupled to the base 10 and is coupled to the at least one cosmetic pan 30 such that some mechanical shock imparted on the cosmetic compact 1 is isolated from the at least one cosmetic pan 30. Hence, the content of the at least one cosmetic pan 30, such as, for example, makeup, is isolated from shocks or vibrations acting upon the cosmetic compact 1. The shock absorbing member 50 prevents transverse or axial movements of the at least one cosmetic pan 30 relative to the frame 40 and the base 10 and dampens effect of impact on the at least one cosmetic pan 30 during a fall or vibrations.

As shown in FIGS. 2-5, the shock absorbing member 50 is a deformable structure that comprises a hollow tubular body 51 defining a central bore 52 extending between an upper flange 54 and a lower flange 55. The upper flange 54 is slanted with respect to a central longitudinal axis of the shock absorbing member and the lower flange 55 is substantially transverse with respect to the central longitudinal axis of the shock absorbing member 50. In other embodiments, the upper flange 54 may be substantially transverse with respect to the central longitudinal axis of the shock absorbing member 50. In still other embodiments, the upper flange 54 and the lower flange 55 both may be substantially transverse or slanted with respect to the central longitudinal axis of the shock absorbing member 50. Further, the upper flange 54 is substantially circular in shape with at least two straight opposite edges 54*a* and 54*b* in the circumference and the lower flange 55 is substantially rectangular in shape with curved corners 55*a*. Further, a maximum width W1 of the upper flange 54 is smaller than a maximum width W2 of the lower flange 55.

Thus, the shock absorbing member 50 has a horizontal annular body which defines an annular U shaped horizontal groove 57 that faces outside and away from the central bore 52. More particularly, the hollow tubular body 51 comprises an upper curved portion 51*a* and a lower curved portion 51*b*. The upper curved portion 51*a* comprises an inner concave surface and an external convex surface. The lower curved portion 51*b* comprises an inner convex surface and an external concave surface.

The shock absorbing member 50 extends between the bottom wall 12 of the base and the frame 40 such that the lower-flange 55 abuts an inner surface of the bottom wall 12 of the base 10 and the upper-flange 54 abuts an inner surface of the frame 40. Further, as shown in FIG. 2, the shock absorbing member 50 extends between the bottom wall 12 of the base and the frame 40 such that the transverse lower-flange 55 abuts an inner surface of the bottom wall 12 of the base 10 and the slanted upper-flange 54 abuts the inner surface of the frame 40.

An upper inner peripheral surface of the hollow tubular body 51 of the shock absorbing member 50 comprises a step 56 onto which an outer flange 32 of the at least one cosmetic pan 30 abuts such that the at least one cosmetic pan 30 is accommodated inside the central bore 52 in a floating state. More particularly, the outer flange 32 of the at least one cosmetic pan 30 abuts a step 56 on the upper inner peripheral surface of the hollow tubular body 51 and the inner concave surface of the upper curved portion 51*a* of the hollow tubular body 51 of the shock absorbing member 50 such that the at least one cosmetic pan 30 is accommodated inside the central bore 52 in a floating state. In other words, the at least one cosmetic pan 30 is supported by the shock absorbing member 50 only at a peripheral wall 33 of the least one cosmetic pan 30 and a bottom wall 34 of the least one cosmetic pan 30 is neither in contact with the shock absorbing member 50 nor with the bottom wall 12 of the base 10.

In various embodiments, not shown, the at least one cosmetic pan 30 may be attached to the shock absorbing member 50 by a glue, a friction tight fitment or any other attaching means known in the art.

Figure 3:
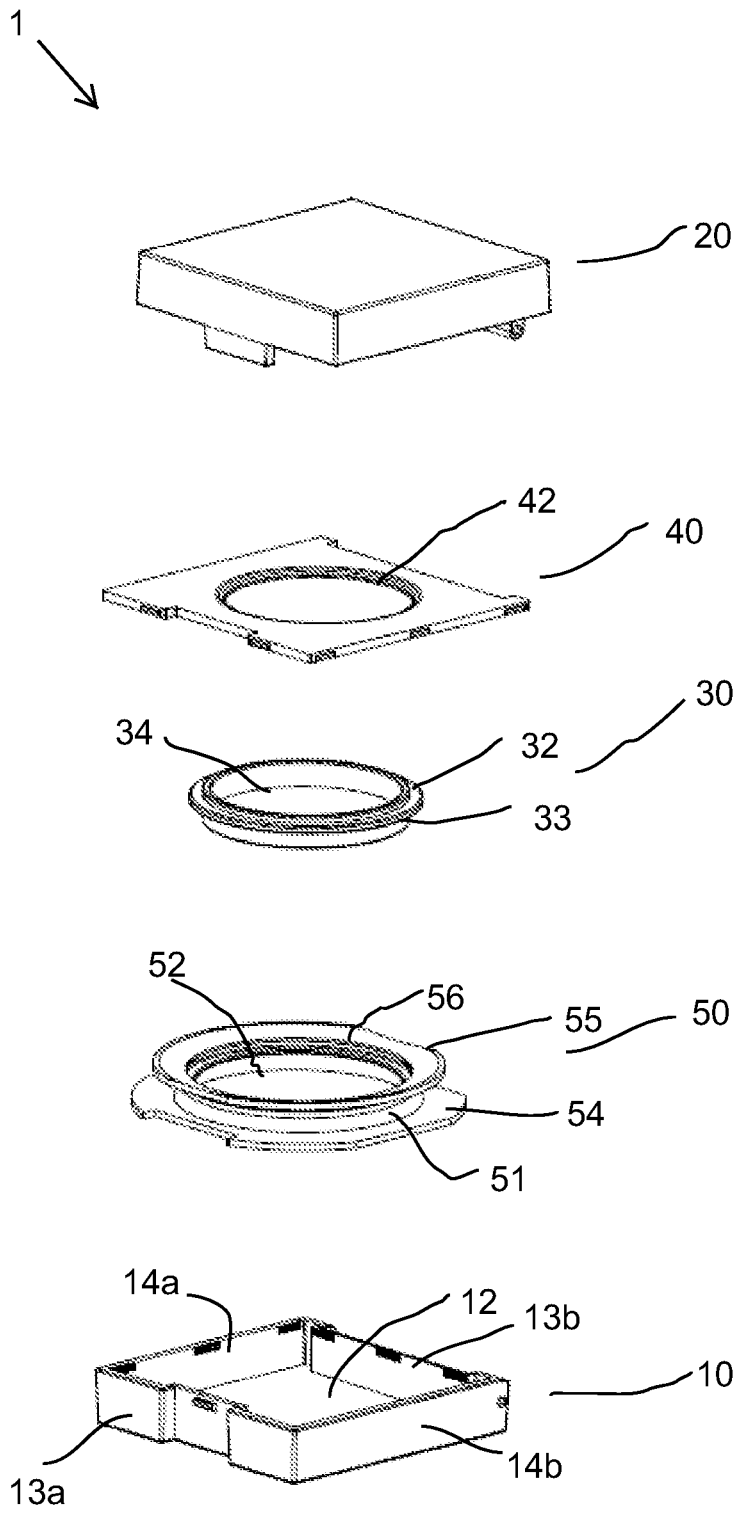
FIG. 3 illustrates an exploded view of view of the cosmetic compact of FIG. 1.
Figure 4:
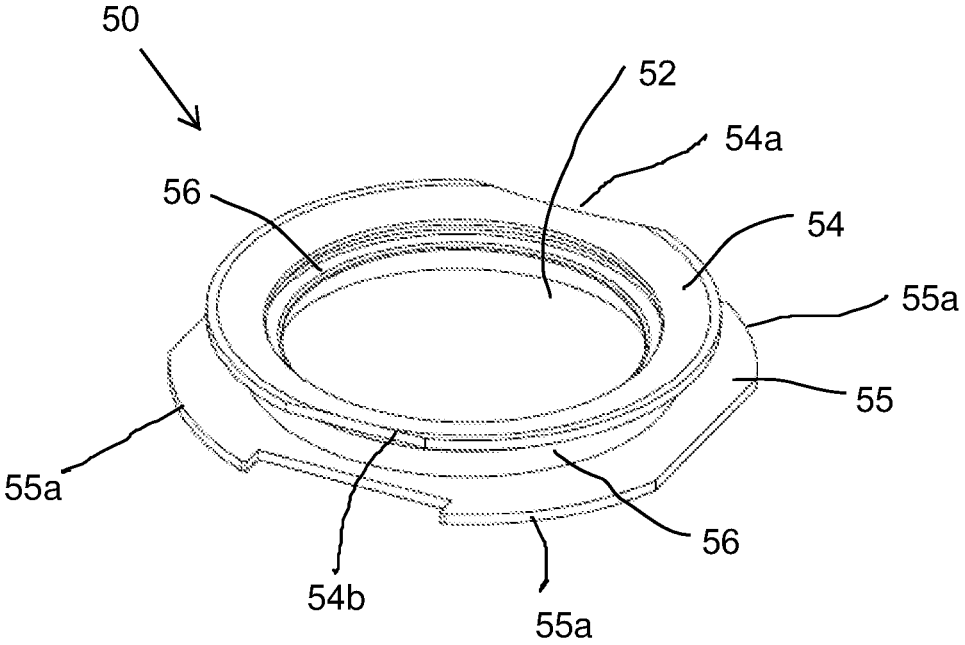
FIG. 4 illustrates a perspective view of a shock absorbing member of FIG. 3.
Figure 5:
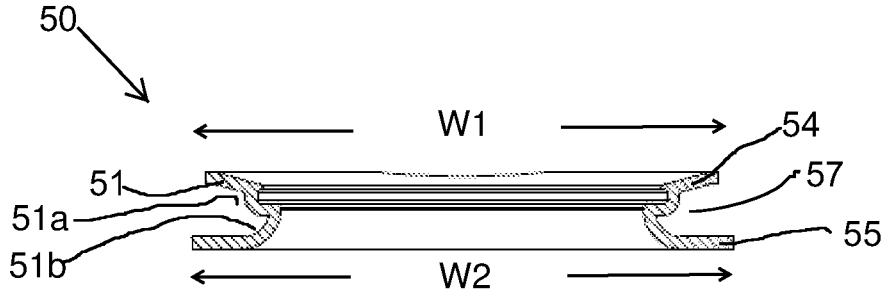
FIG. 5 illustrates a cross sectional view of the shock absorber member of FIG. 4.

Further, the frame 40 includes an opening 42 that provides access to the contents of the at least one cosmetic pan 30, shown in FIG. 3. The frame 40 locks the at least one cosmetic pan 30 with the shock absorbing member 50 within the base 10.

Figure 6:
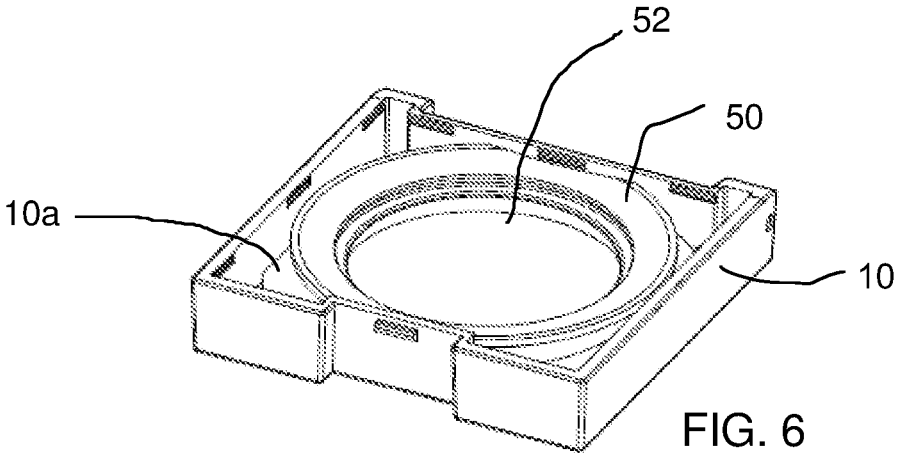
FIG. 6-7 illustrates steps of assembling a base assembly of the cosmetic compact of FIG. 1.
Figure 7:
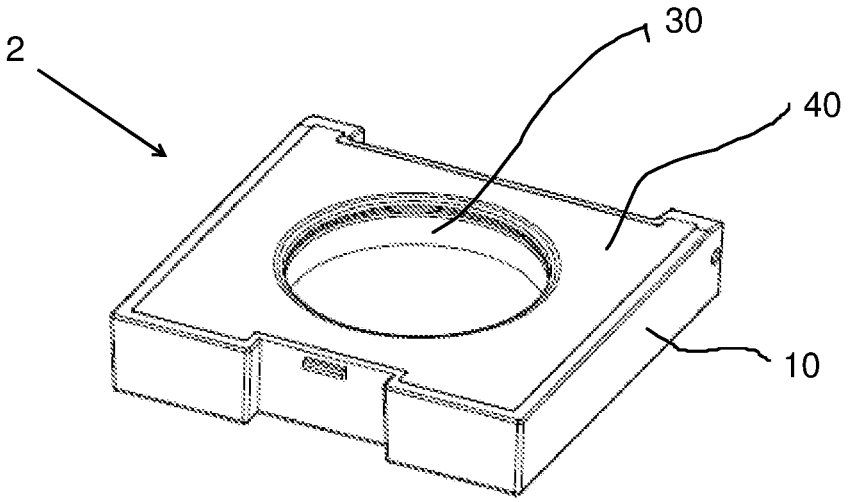

Furthermore, FIGS. 6-7 show steps of assembling a base assembly of the cosmetic compact 1. The shock absorbing member 50 is first securely received in the cavity 10*a* of the base 10 as shown in FIG. 6. Subsequently, the at least one cosmetic pan 30 is secured within the bore 52 of the shock absorbing member 50 and thereafter, the frame 40 is mounted over the base 10 to retain the at least one cosmetic pan 30 within the base 10 as shown in FIG. 7.

According to an aspect of the present disclosure, the shock absorbing member 50 is made of a flexible material. The shock absorbing member 50 may be made from any suitable plastic or elastomer material, such as, for example, rubber, styrene, acetal, polyethylene, polypropylene. The member may be made by any suitable method, such as, for example, injection molding, die-cutting, etc.

According to an aspect of the present disclosure, the at least one cosmetic pan 30 may be made from a metal material such as aluminum or plastic or any other material known in art.

At least one of said lid 20 and said base 10 is made of a material selected from the group consisting of transparent plastic, opaque plastic, metal, wood, composite, polymer, and ceramic.

The lid 10 and/or the base 20, may take any shape desired, such as, but not limited to, circular, square, rectangular, polygonal, etc.

It should be understood that the foregoing description is only illustrative of the present disclosure. Various alternatives and modifications can be devised by those skilled in the art without departing from the disclosure. Accordingly, the present disclosure is intended to embrace all such alternatives, modifications and variations that fall within the scope of the appended claims.

What is claimed is:

1. A cosmetic compact for housing a cosmetic product, the cosmetic compact comprising a lid and a base assembly wherein the base assembly comprises:

a base configured to be covered by the lid and configured to house at least one cosmetic pan;

a shock absorbing member disposed within the base; and wherein the shock absorbing member comprises:

a tubular body; and a hollow extending through the tubular body having an inner most diameter defining a central bore extending between an upper flange and a lower flange, wherein the inner most diameter of the shock absorbing member is sized to accommodate the sidewalls of the cosmetic pan and the shock absorbing member is configured to isolate the cosmetic pan from the base.

2. The cosmetic compact according to claim 1, wherein the shock absorbing member has a flexible and deformable structure.

3. The cosmetic compact according to claim 1, wherein the upper flange is slanted with respect to a central longitudinal axis of the shock absorbing member and the lower flange is substantially transverse with respect to the central longitudinal axis of the shock absorbing member; or wherein the upper flange is substantially transverse with respect to a central longitudinal axis of the shock absorbing member and the lower flange is slanted with respect to the central longitudinal axis of the shock absorbing member; or wherein both the upper flange and the lower flange are substantially transverse or slanted with respect to a central longitudinal axis of the shock absorbing member.

4. The cosmetic compact according to claim 1, wherein the upper flange is substantially circular in shape with at least two straight opposite edges in the circumference and the lower flange is substantially rectangular in shape with curved corners.

5. The cosmetic compact according to claim 1, wherein the upper flange extends to the base.

6. The cosmetic compact according to claim 1, wherein the shock absorbing member has a horizontal annular body which defines an annular U shaped horizontal groove that faces outside and away from the central bore.

7. The cosmetic compact according to claim 1, wherein the hollow tubular body comprises an upper curved portion and a lower curved portion.

8. The cosmetic compact according to claim 7 wherein the upper curved portion comprises an inner concave surface and an external convex surface.

9. The cosmetic compact according to claim 7, wherein the lower curved portion comprises an inner convex surface and an external concave surface.

10. The cosmetic compact according to claim 1, wherein an upper inner peripheral surface of the hollow tubular body of the shock absorbing member comprises a step onto which an outer flange of the at least one cosmetic pan abut such that the at least one cosmetic pan is accommodated inside the central bore in a floating state.

11. The cosmetic compact according to claim 10, wherein an outer flange of the at least one cosmetic pan abuts a step on the upper inner peripheral surface of the hollow tubular body and an inner concave surface of an upper curved portion of the hollow tubular body of the shock absorbing member.

12. The cosmetic compact according to claim 10, wherein the at least one cosmetic pan is supported by the shock absorbing member only at a peripheral wall of the least one cosmetic pan and a bottom wall of the least one cosmetic pan is neither in contact with the shock absorbing member nor with the bottom wall of the base.

13. The cosmetic compact according to claim 1, wherein a transverse lower-flange abuts an inner surface of the bottom wall of the base and a slanted upper-flange abuts an inner surface of the frame.

14. The cosmetic compact according to claim 1, wherein a cavity is provided between the base and the shock absorbing member.

15. A cosmetic compact comprising:

a lid;

a base having a bottom and sidewalls, the base configured to be covered by the lid and configured to house at least one cosmetic pan having outer sidewalls; and a shock absorbing member disposed within the base, wherein the shock absorbing member comprises:

a tubular body;

a hollow extending through the tubular body defining an inner most diameter, wherein the inner most diameter is sized to accommodate the outer sidewalls of the cosmetic pan; and an upper flange extending from the tubular body away from the cosmetic pan toward the sidewalls of the base, wherein the shock absorbing member is configured to isolate the cosmetic pan from bottom and sidewalls of the base.

16. The cosmetic compact according to claim 15, wherein the upper flange contacts the sidewalls.

17. The cosmetic compact according to claim 15, wherein the shock absorbing member further comprises:

a lower flange, wherein a cavity is formed between the lower flange, upper flange and the sidewall of the base.

18. The cosmetic compact according to claim 17, further comprising:

a step is formed on the inner diameter of the shock absorbing member between the upper flange and the lower flange, wherein step is configured to engage the at least one cosmetic pan.

19. The cosmetic compact according to claim 18, wherein a portion of the upper flange extends over the step.

20. The cosmetic compact according to claim 15, wherein the shock absorbing member is made of a material selected from a group consisting of plastic or elastomeric material, such as, for example, rubber, styrene, acetal, polyethylene, polypropylene.

* * * * *